US006865977B1

(12) United States Patent
Kim et al.

(10) Patent No.: US 6,865,977 B1
(45) Date of Patent: Mar. 15, 2005

(54) PROTECTIVE PACKAGING DEVICE FOR BLAST AND FRAGMENTATION MITIGATION

(75) Inventors: Robert M. Kim, Lyndhurst, NJ (US); Stephan P. Kaiser, Oberahr (DE); Michael W. Selk, Rockaway, NJ (US); James F. Zoll, Flanders, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 230 days.

(21) Appl. No.: 10/604,320

(22) Filed: Jul. 10, 2003

(51) Int. Cl.[7] ..... F42B 33/00
(52) U.S. Cl. ..... 86/50; 206/3; 109/49.5
(58) Field of Search ..... 86/50; 89/34, 36.01; 588/202; 206/3, 196, 199, 223, 239; 109/49.5

(56) References Cited

U.S. PATENT DOCUMENTS 3,721,201 A * 3/1973 Boller ..... 109/49.5
3,800,715 A * 4/1974 Boller ..... 109/49.5
4,727,789 A * 3/1988 Katsanis et al. ..... 86/50
5,158,173 A * 10/1992 Halsey et al. ..... 206/3
5,160,468 A * 11/1992 Halsey et al. ..... 264/112
5,366,105 A * 11/1994 Kerman et al. ..... 220/62.11
5,390,580 A * 2/1995 Gibbons et al. ..... 86/50
5,394,786 A * 3/1995 Gettle et al. ..... 86/50
6,557,650 B2 * 5/2003 Fayard et al. ..... 175/4.59

* cited by examiner

*Primary Examiner*—Michael J. Carone
*Assistant Examiner*—Troy Chambers
(74) *Attorney, Agent, or Firm*—Robert C. Beam; John F. Moran

(57) ABSTRACT

A protective packaging device provides mitigation of the blast effect and fragmentation of a hand grenade when the grenade is detonated. The device includes at least one protective housing assembly, formed by inner and outer nested housing members, in which the hand grenade is received, and which, in response to detonation of the grenade, retains fragments of the grenade while providing controlled release, through the mesh material, of gases formed upon detonation. A cushioning container includes a cushioning material having a plurality of open compartments therein in which a corresponding plurality of the protective housing assemblies are received.

16 Claims, 2 Drawing Sheets

PROTECTIVE PACKAGING DEVICE FOR BLAST AND FRAGMENTATION MITIGATION

FEDERAL RESEARCH STATEMENT

[The inventions described herein may be manufactured, used and licensed by or for the U.S. Government for U.S. Government purposes.]

BACKGROUND OF INVENTION

Although, as will become apparent, the present invention is not limited to such an application, the exemplary application that is discussed below concerns mitigation of the effects of the detonation of hand grenades. It is evident from past experience that the safe storage and handling of hand grenades present a problem in that even though grenades include a safety pin and are disarmed unless actively armed, accidental detonation of hand grenades can occur and has occurred in the past. Further, the conventional packs or packaging currently used in the storage and handling of grenades is of limited effectiveness in mitigating against the blast and fragmentation that occurs when a grenade is accidentally detonated. As will be appreciated, this can be a particular hazard when hand grenades are shipped with other incompatible explosives.

SUMMARY OF INVENTION

In accordance with the invention, there is provided a protective packaging device for energetic elements, such as hand grenades and other munitions, which possesses a number of important advantages. For example, the device of the invention reduces fragmentation, and provides for slow release of the gases formed during detonation. Further, the device decreases the hazard classification of munitions stored therein, complies with Insensitive Munitions (IM) standards, and prevents destruction of other ammunition that is transported therewith (thereby resulting in the aforementioned lower hazard classification). In addition, the device potentially provides a reduction in costs. A key advantage of the invention is that it supports safe handling of grenades and other energetic elements in the storage and transport thereof, and, as just indicated, permits the shipment of incompatible explosives, by forming an IM barrier that is intended to prevent sympathetic detonation of other energetic elements and to assist in providing an effective response to both bullet and fragmentation impacts.

In accordance with one aspect of the invention, there is provided a protective packaging device for mitigation of blast effects and fragmentation of an energetic element when the energetic element is detonated, the device comprising at least one protective housing member in which an energetic element is received, the housing member being comprised of a mesh material for retaining fragments of the energetic element upon detonation. thereof while providing controlled release through the mesh material of gases formed upon detonation of the energetic element.

In a very important implementation of the device, the at least one housing member comprises inner and outer nested housing members comprised of a mesh material and forming a protective housing assembly. The housing members are advantageously made of steel mesh although other, like materials can also be used.

Preferably, the device further comprises at least one cushioning container comprised of a cushioning material having a plurality of open compartments therein and a plurality of the protective housing assemblies are provided, with each of the protective housing assemblies being received in a respective one of the compartments of the cushioning material. Advantageously, the container also includes a cover. Preferably, the at least one cushioning container comprises a plurality of stackable containers so as to enable storage and transport of a large number of energetic elements.

In another specific important implementation, the energetic element comprises a grenade, the inner and outer nested housing members are of substantially cup-shaped construction and the inner housing member is open at the top and has an inner profile substantially matching that of the grenade. Such a grenade typically includes an operating lever and, advantageously, the inner profile of the inner housing member includes a recess for accommodating the operating lever of the grenade.

Further features and advantages of the present invention will be set forth in, or apparent from, the detailed description of preferred embodiments thereof which follows.

DETAILED DESCRIPTION

Figure 1:
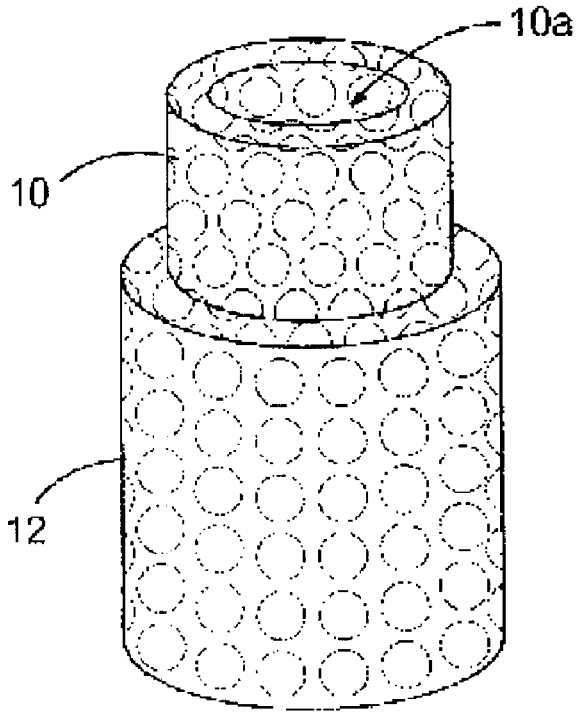
FIG. 1 is an exploded perspective view of a protective packaging device for a hand grenade, constructed in accordance with a preferred embodiment of the invention.

Referring to FIG. 1, there is shown a pair of nested mesh cups 10 and 12 constructed in accordance with a preferred embodiment of the invention. In FIG. 1, the cups 10 and 12 are shown in an intermediate position wherein inner cup 10 is being inserted into outer cup 12. Both cups 10 and 12 are preferably constructed of a steel mesh material which is molded or pressed into a cup or bowl-like shape as shown. Although cups 10 and 12 are preferably made of steel mesh, it will, of course, be understood that other like mesh materials can be used. Further, although the cup shape illustrated is preferred for a grenade, other shapes can be used for applications involving different explosives or munitions. In an exemplary embodiment, the mesh size of the steel mesh material used to make cups 10 and 12 is 0.01 to 0.02 inches. Preferably, the mesh is a woven mesh which is compressed to form the mesh material. It is believed that such a compressed, woven mesh will relieve the pressure more rapidly than other forms of mesh material.

Figure 2:
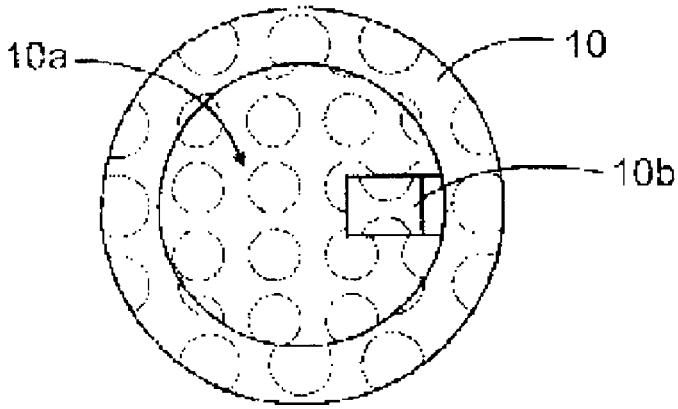
FIG. 2 is a top plan view of the inner mesh cup of the packaging device of FIG. 1.
Figure 3:
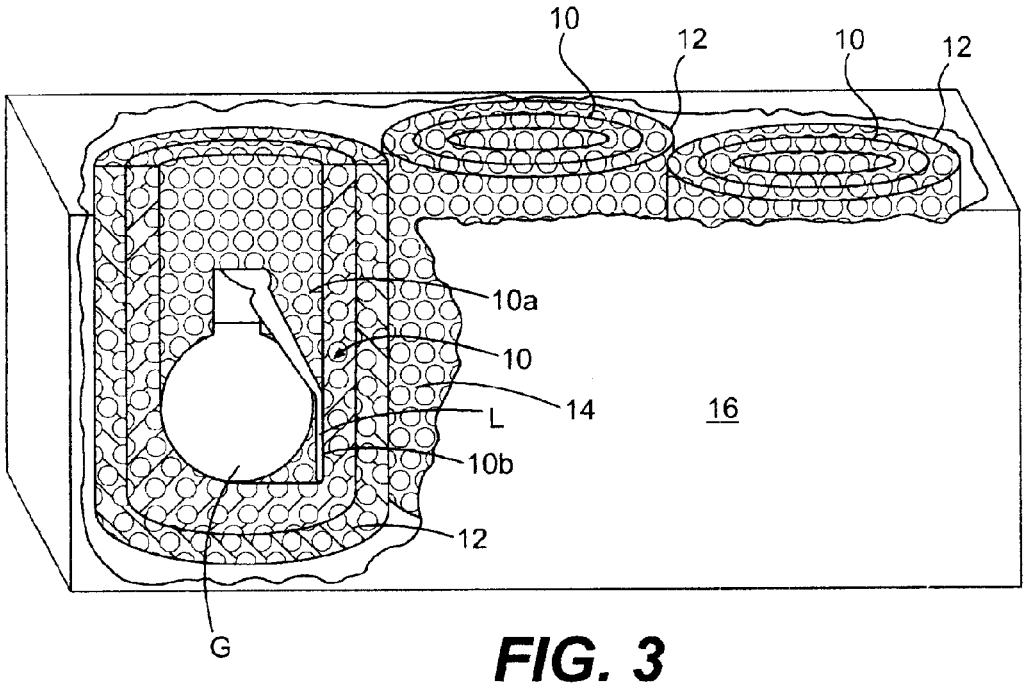
FIG. 3 is a partially broken away perspective view of a container for plural protective devices corresponding to that shown in FIG. 1, constructed in accordance with a preferred embodiment of the invention.

As shown in FIG. 2, and as is also shown in FIG. 3, the inner cup 10 defines a central cup-shaped compartment 10*a* which is open at the top and includes a specially spaced, recessed portion 10*b* for receiving, as illustrated in FIG. 3, the operating lever L of a conventional grenade G. Outer cup 12 itself includes a similar shaped compartment (without recess 10*b*) in which inner cup 10 is received and which is sized such that, in use, inner cup 10 nests completely inside outer cup and the top edge surfaces of the cups 10, 12 lie flush with each other.

Figure 4:
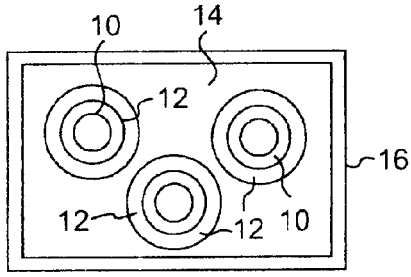
FIG. 4 is a top plan view of the container of FIG. 3, with the top removed.

Referring to FIGS. 3 and 4, in an exemplary, non-limiting embodiment, three sets of nested cups 10, 12 are disposed in reciprocally shaped, laterally spaced receiving compartments or recesses in a cushioning material or cushion 14 which itself is received in an outer container or housing 16. A cover 18, which may be constructed in part, or as a whole, of a mesh material similar to that of cups 10, 12, is fitted on container 16 so as to cover the tops of nested cups 10 and 12. As indicated at the left side of FIG. 3, and was mentioned above, a grenade G is shown as being received in the central cup-shaped compartment 10*a* in one of the three sets of nested cups 10, 12, with the operating lever L of the grenade G being received in recessed portion 10*b* of compartment 10*a*.

Figure 5:
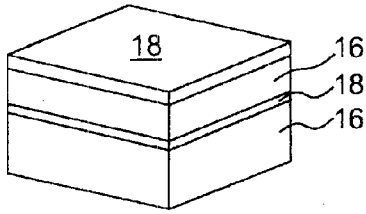
FIG. 5 is a perspective view of two stacked containers corresponding to that shown in FIGS. 3 and 4.

As shown in FIG. 5, two (or more) containers 16 with covers 18 can be stacked so that any number of grenades or other munitions can be protectively housed and stored.

As was indicated above, the blast/fragmentation mitigation pack or packaging device of the invention provides a number of important advantages over prior munition handling approaches. For example, the nested mesh cups reduce fragmentation, decrease hazard classification, enable compliance with insensitive munitions restrictions, prevent the destruction of other ammunition from the detonation reaction of a grenade packaged thereby, and provide potential cost reductions. The nested mesh cups of the invention enable safe handling of grenades in both storage and transport modes and allow shipment of protected grenades with otherwise incompatible explosives. As indicated above, the nested mesh cups are also adaptable for use in storing and transporting of other high explosives with other ammunition of a lower hazard classification.

In preliminary testing with containers with and without nested mesh cups corresponding to cups 10, 12, a grenade in a container without the mesh cups dismantled the container with grenade fragments piercing through the container, whereas a grenade in a container and received in the mesh cups dismantled the container without any fragments piercing through the container.

Although the invention has been described above in relation to preferred embodiments thereof, it will be understood by those skilled in the art that variations and modifications can be effected in these preferred embodiments without departing from the scope and spirit of the invention.

What is claimed is:

1. A protective packaging device for mitigation of blast effect and fragmentation of an energetic element when the energetic element is detonated, said device comprising:

at least one protective housing member in which an energetic element is received, said housing member being comprised of a mesh material for retaining fragments of the energetic element upon detonation thereof while providing controlled release through the mesh material of gases formed upon detonation.

2. A device as claimed in claim 1 wherein said at least one housing member comprises inner and outer nested housing members comprised of a mesh material and forming a protective housing assembly.

3. A device as claimed in claim 2 wherein said device further comprises at least one cushioning container comprised of a cushioning material having a plurality of open compartments therein and wherein a plurality of said protective housing assemblies are provided, each of said protective housing assemblies being received in a respective one of said compartments of said cushioning material.

4. A device as claimed in claim 3 wherein said container includes a cover.

5. A device as claimed in claim 4 wherein said at least one cushioning container comprises a plurality of stackable containers.

6. A device as claimed in claim 5 wherein said energetic element comprises a grenade, said inner and outer nested housing members are of substantially cup-shaped construction and said inner housing member has an inner profile substantially matching that of the grenade.

7. A device as claimed in claim 6 wherein the grenade includes an operating lever and the inner profile of said inner housing member includes a recess for accommodating said lever.

8. A device as claimed in claim 2 wherein said housing members are constructed of steel mesh.

9. A device as claimed in claim 2 wherein said energetic element comprises a grenade, said inner and outer nested housing members are of substantially cup-shaped construction and said inner housing member has an inner profile substantially matching that of the grenade.

10. A device as claimed in claim 9 wherein the grenade includes an operating lever and the inner profile of said inner housing member includes a recess for accommodating said lever.

11. A protective packaging device for mitigation of blast effect and fragmentation of a hand grenade when the grenade is detonated, said device comprising:

at least one protective housing member in which a hand grenade is received, said housing member being comprised of a mesh material for retaining fragments of the grenade upon detonation thereof while providing controlled release through the mesh material of gases formed upon detonation of the hand grenade.

12. A device as claimed in claim 10 wherein said at least one housing member comprises inner and outer nested housing members comprised of a mesh material and forming a protective housing assembly.

13. A device as claimed in claim 12 wherein said device further comprises at least one cushioning container comprised of a cushioning material having a plurality of open compartments therein and wherein a plurality of said protective housing assemblies are provided, each of said housing assemblies being received in a respective one of said compartments of said cushioning material.

14. A device as claimed in claim 13 wherein said container includes a cover.

15. A device as claimed in claim 14 wherein said at least one cushioning container comprises a plurality of stackable containers stacked to form a unit.

16. A device as claimed in claim 12 wherein said housing members are made of steel mesh.

* * * * *